US010895442B1

(12) United States Patent
Quail

(10) Patent No.: US 10,895,442 B1
(45) Date of Patent: Jan. 19, 2021

(54) SIMULATED EXPLOSIVE DEVICE FOR COMBAT TRAINING

(71) Applicant: Jeffrey James Quail, Winnipeg (CA)

(72) Inventor: Jeffrey James Quail, Winnipeg (CA)

( * ) Notice: Subject to any disclaimer, the term of this patent is extended or adjusted under 35 U.S.C. 154(b) by 0 days.

(21) Appl. No.: 16/545,137

(22) Filed: Aug. 20, 2019

(51) Int. Cl.
*F42B 12/36* (2006.01)
*F42B 8/26* (2006.01)

(52) U.S. Cl.
CPC ..... *F42B 8/26* (2013.01); *F42B 12/36* (2013.01)

(58) Field of Classification Search
CPC .. F42B 8/26; F42B 12/36; F42B 12/42; F42B 27/00; F42B 27/08
USPC ..... 102/335, 482, 486, 487, 498
See application file for complete search history.

(56) References Cited

U.S. PATENT DOCUMENTS 4,416,631 A * 11/1983 Dawson ..... F41A 33/04 102/432
5,180,878 A * 1/1993 Denchfield ..... F41A 33/04 102/702
5,824,945 A 10/1998 Barlog et al.
5,942,715 A * 8/1999 Denchfield ..... F41A 33/04 102/702
7,341,002 B1 * 3/2008 Baker ..... F42B 12/36 102/336
9,103,638 B2 8/2015 Thomas
2010/0294157 A1 * 11/2010 Dindl ..... F42B 12/48 102/334
2011/0311948 A1 12/2011 Lu et al.
2012/0186479 A1 * 7/2012 Skidmore ..... F42C 15/24 102/364

* cited by examiner

*Primary Examiner* — Michael D David
(74) *Attorney, Agent, or Firm* — Ryan W. Dupuis; Ade & Company Inc.; Kyle R. Satterthwaite

(57) ABSTRACT

A simulated improvised explosive device has a cylindrical outer casing and a cylindrical inner casing received within the outer casing to define an annular first passage between the inner and outer casings and a second passage within the inner casing. A charge holder supports a charge at a first end of the second passage. The second ends of the inner and outer passages communicate with one another opposite from the charge holder. Exhaust ports are located at the first end of the first passage so that the expelled gases from detonating the charge are directed substantially along a full length of both passages. A flow restriction is provided within the first passage to assist in containing sparks within the outer casing rather than be expelled from the exhaust ports.

12 Claims, 4 Drawing Sheets

SIMULATED EXPLOSIVE DEVICE FOR COMBAT TRAINING

FIELD OF THE INVENTION

The present invention relates to a device for simulating the noise of an improvised explosive device within a combat training environment, and more particularly, the present invention relates to a device which allows detonation of a charge within a casing in a manner that contains substantially sparks from the detonation while allowing the sound of the detonation to escape.

BACKGROUND

In order to train armed forces in realistic combat environments, it is desirable in many instances to simulate explosions of various types, including improvised explosive devices such as pipe bombs and the like. In many instances in the prior art of simulated explosive devices, attention is given to providing visual representation of an explosion; however, more realistically simulating the sound of an explosive device better acclimatizes trainees to the stress induced by explosive devices in real combat environments.

US 2011/0311948 by Lu et al discloses a gas balance training bomb which is charged with high-pressure gas for expelling an eruption solid, powder, gas or liquid when activated so as to achieve an effect of visually simulating an explosion. The ability to simulate the sound of a detonating improvised explosive device is limited when relying on high-pressure gas for activation instead of a pyrotechnic charge.

U.S. Pat. No. 5,824,945 by Barlog et al and U.S. Pat. No. 9,103,638 by Thomas disclose examples of diversion or distraction devices in which pyrotechnic material is detonated with the specific intention of producing noise and light which are ejected from the device. Although a realistic sound is generated, in each instance high temperature sparks are purposely discharged for visually distracting combatants; however, such high temperature sparks can run safely start a fire or cause burn damage to the surrounding environment when used for training purposes.

SUMMARY OF THE INVENTION

According to one aspect of the invention there is provided a simulated explosive device for use with a pyrotechnic charge, the device comprising:

an outer casing extending in a longitudinal direction between a first end and a second end of the outer casing;

a first exhaust passage defined within the outer casing to extend in the longitudinal direction between a first end of the first exhaust passage in proximity to the first end of the outer casing and a second end of the first exhaust passage in proximity to the second end of the outer casing;

an inner casing supported within the outer casing to extend in the longitudinal direction between a first end and a second end of the inner casing;

a second exhaust passage defined within the inner casing to extend in the longitudinal direction between a first end of the second exhaust passage in proximity to the first end of the inner casing and a second end of the second exhaust passage in proximity to the second end of the inner casing;

a charge holder supported at the first end of the second exhaust passage so as to be arranged to support the pyrotechnic charge in communication with the first end of the second exhaust passage;

at least one intermediate port in communication between the second end of the second exhaust passage and the second end of the first exhaust passage;

at least one exhaust port in communication from the first exhaust passage to an exterior of the outer casing;

said at least one exhaust port being in proximity to the first end of the first exhaust passage.

The combination of first and second exhaust passages which only communicate with one another through the intermediate ports at the second ends of the passages opposite from the charge holder and the exhaust ports ensures that high temperature sparks generated by detonation of the pyrotechnic charge must travel substantially a full length of both passages in opposing directions such that the high temperature sparks are more likely to remain safely contained within the outer casing of the device. This is accomplished in a manner which still allows a significant amount of sound resulting from the detonation to be communicated externally of the outer casing. The sound of an explosion can thus be produced in a safe manner within a training environment without risk of starting a fire or cause burn damage to the training environment.

Preferably, a flow restrictor is supported in the first exhaust passage. The flow restrictor may be located at an intermediate location along the first exhaust passage, spaced inwardly from both the first end and the second end of the first exhaust passage, and more preferably the flow restrictor is located nearer to the second end of the first exhaust passage than the first end of the first exhaust passage. The flow restrictor may comprise a restrictor body spanning across the first exhaust passage and a plurality of restrictor ports communicating in the longitudinal direction through the restrictor body.

Preferably the outer casing is devoid of openings in communication with the first exhaust passage between the second end of the first exhaust passage and said at least one exhaust port that is in proximity to the first end of the first exhaust passage. More preferably, the outer casing is devoid of openings in communication with the first exhaust passage along a majority of a length of the first exhaust passage. When also providing the flow restrictor supported in the first exhaust passage between the first end of the first exhaust passage and said at least one exhaust port, preferably the outer casing is devoid of openings in communication with the first exhaust passage between the second end of the first exhaust passage and the flow restrictor.

In the illustrated embodiment, the exhaust port(s) extend radially through a cylindrical wall of the outer casing.

Also, in the illustrated embodiment, the intermediate port(s) extend radially through a cylindrical wall of the inner casing between the second exhaust passage and the first exhaust passage.

Preferably the inner casing is received within the first exhaust passage of the outer casing such that the first exhaust passage is annular in shape between the inner casing and the outer casing.

The device preferably also includes (i) a striker supported on the second end of the outer casing so as to be slidable between a striking position in proximity to the charge holder and an armed position spaced from the charge holder, (ii) a biasing element coupled to the striker to bias the striker towards the striking position, and (iii) an arming pin releasable coupled to the striker to selective retain the striker in the armed position.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
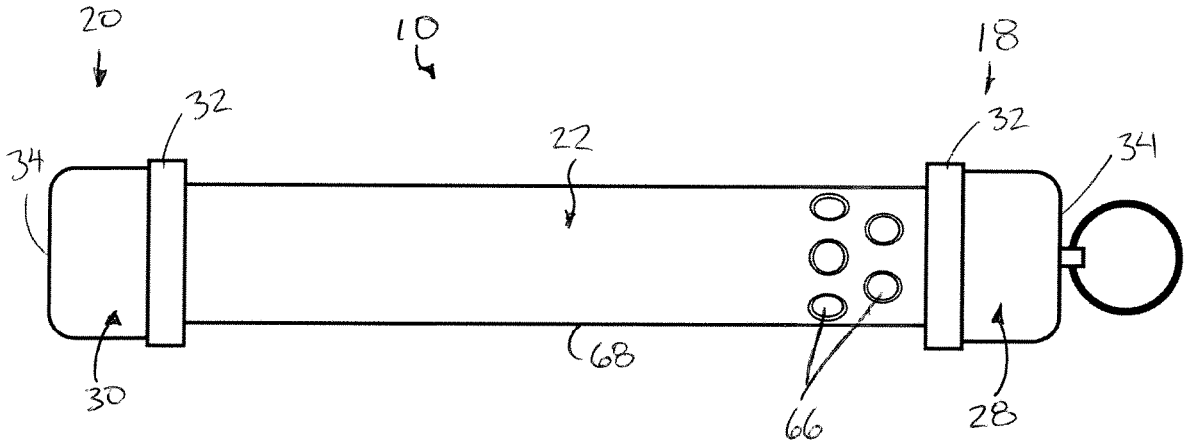
FIG. 1 is a side elevational view of the simulated explosive device.
Figure 2:
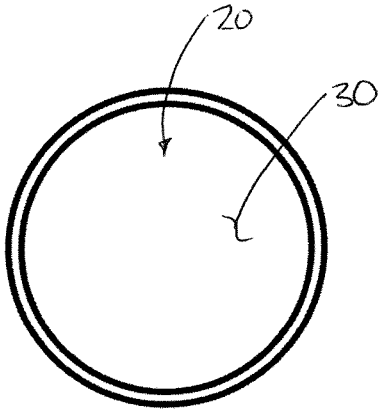
FIG. 2 is an end view of a second end of the simulated explosive device.
Figure 3:
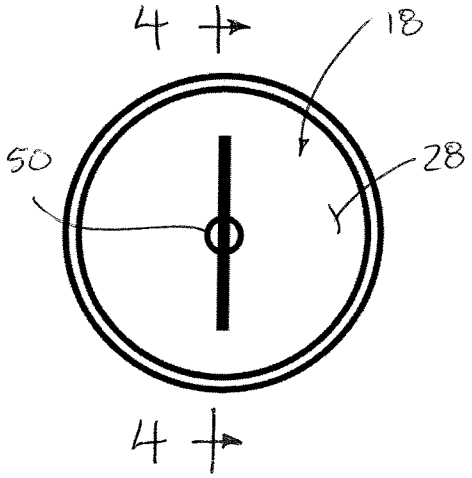
FIG. 3 is an end view of the first end of the simulated explosive device.
Figure 4:
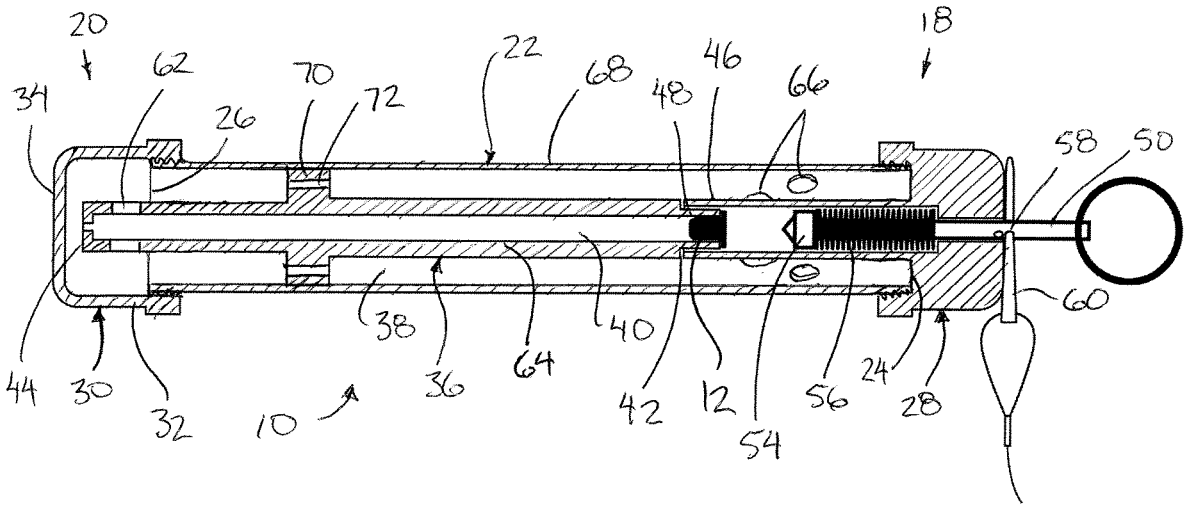
FIG. 4 is a sectional view along the line 4-4 in FIG. 3 in which the simulated explosive device is shown in the armed position.

Referring to the accompanying figures there is illustrated a simulated explosive device generally indicated by reference numeral 10. The device 10 is particularly suited for simulating an improvised explosive device (IED), for example simulating a pipe bomb, within a simulated combat environment for training purposes.

The device 10 is typically used in cooperation with a pyrotechnic charge 12, that is an apparatus that is capable of forming an exothermic chemical reaction to make heat, light, gas, sound, or any combination thereof.

In the illustrated example, the pyrotechnic charge 12 comprises a primer charge having a shock sensitive chemical contained with a casing and which is arranged to be ignited when the casing is struck, for example by a firing pin or striker. The casing of the pyrotechnic charge includes a cylindrical main body portion 14 and a flange portion 16 protruding radially from one end of the main body portion.

In further embodiments, the pyrotechnic charge 12 may comprise a blank firearm cartridge having a casing with propellant and a primer charge supported therein, but that contains no projectile. The primer charge in this instance similarly contains a shock sensitive chemical contained therein which is arranged to be ignited when the casing is struck for subsequently igniting the propellant. In this instance, the casing of the blank may be a non-standard size to ensure that standard size ammunition cannot be inadvertently used with the simulated explosive device 10.

According to the illustrated embodiment, the device 10 is elongate in a longitudinal direction between a first end 18 and a second end 20 of the device. The device includes an outer casing 22 in the form of an elongate cylindrical tube which substantially spans the full length of the device between a first end 24 of the outer casing at the first end of the device and a second end 26 of the outer casing at the second end of the device.

The cylindrical tube forming the outer casing is externally threaded at both ends for threaded mounting of a first end cap 28 onto the first end 24 of the outer casing and for threaded mounting of a second end cap 30 onto the second end 26 of the outer casing such that the end caps substantially fully enclose the opposing ends of the outer tube forming the outer casing 22. Each end cap includes a cylindrical side wall portion 32 which is internally threaded for mating with the corresponding threads on the outer casing and a circular end wall 34 spanning the outer end of the cylindrical side wall for enclosing the outer end.

The device 10 also includes an inner casing 36 which is received coaxially within the outer casing 22. The inner casing comprises a cylindrical sleeve having an outer diameter which is reduced relative to the inner diameter of the outer casing such that mounting of the inner casing 36 within the outer casing 22 defines an annular first passage 38 extending in the longitudinal direction of the device which is defined between the inner and outer casings. An inner second passage 40 is also defined by the inner casing, extending longitudinally through the hollow interior of the inner casing 36. The inner casing extends in the longitudinal direction from a first end 42 of the inner casing which is spaced longitudinally inward from the first end of the outer casing, to a second end 44 of the inner casing which is in proximity to the second end of the outer casing.

The inner casing 36 is supported in the axial direction relative to the outer casing by connection to the first end cap 28. In addition to the cylindrical sidewall 32 and the cylindrical end wall 34, the first end cap further includes a sleeve portion 46 which is elongate in the longitudinal direction to extend inwardly from the inner side of the end wall 34 in axial alignment with the inner casing 36. The sleeve portion has an outer diameter which is approximately equal to the outer diameter of the inner casing 36. The sleeve portion 46 spans the longitudinal distance from the first end cap to the first end 42 of the inner casing 36.

The first end of the inner casing 36 is coupled to the inner end of the sleeve portion 46 by forming the first end of the inner casing to be stepped in outer diameter adjacent the first end thereof. A first end portion 48 is thus defined which is reduced in outer diameter relative to the remainder of the inner casing and relative to the sleeve portion 46 so that the outer diameter of the end portion 48 corresponds approximately to the inner diameter of the sleeve portion 46. Cooperating threads on the end portion 48 and the inner surface of the inner end of the sleeve portion 46 enables threaded connection of the first end of the inner casing 36 to the inner end of the sleeve portion 46 of the first end cap to fixedly couple the inner casing relative to the first end cap. Threaded connection of the first end cap to the outer casing in turn fixes the inner casing relative to the outer casing.

The first end of the inner casing 36 is also formed such that the inner diameter closely matches the outer diameter of the main body portion 14 of the pyrotechnic charge 12 but which is reduced relative to the flange 16 of the charge 12. In this instance, the flange 16 abuts the end face at the first end of the inner casing 36 when the main body 14 of the charge is received within the open end of the inner casing. The inner end of the inner casing thus defines a charge holder for holding the charge 12 in a suitable position for cooperation with a striker assembly described in further detail below.

Figure 5:
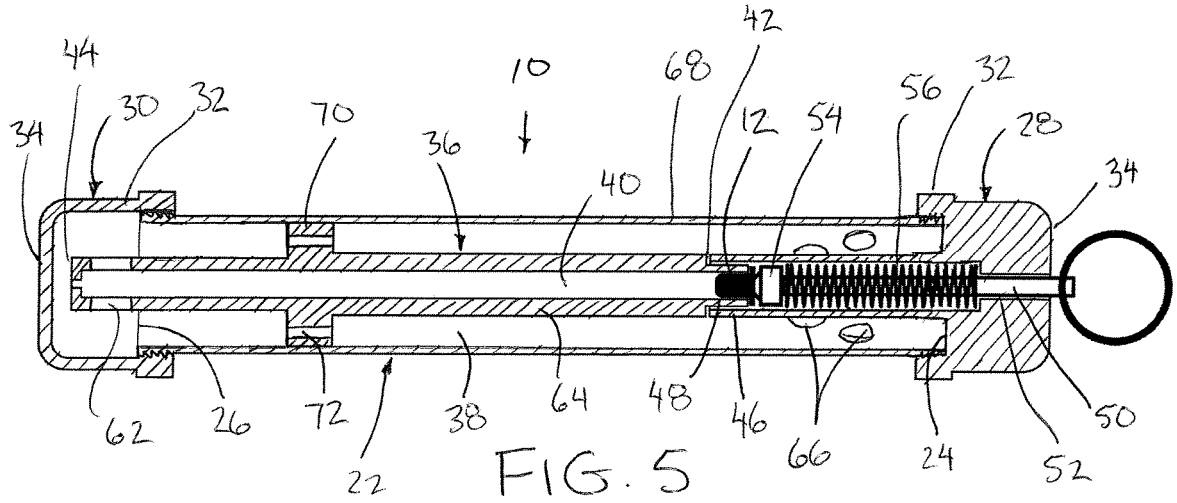
FIG. 5 is a sectional view along the line 4-4 in FIG. 3 in which the simulated explosive device is shown in the detonating position.
Figure 6:
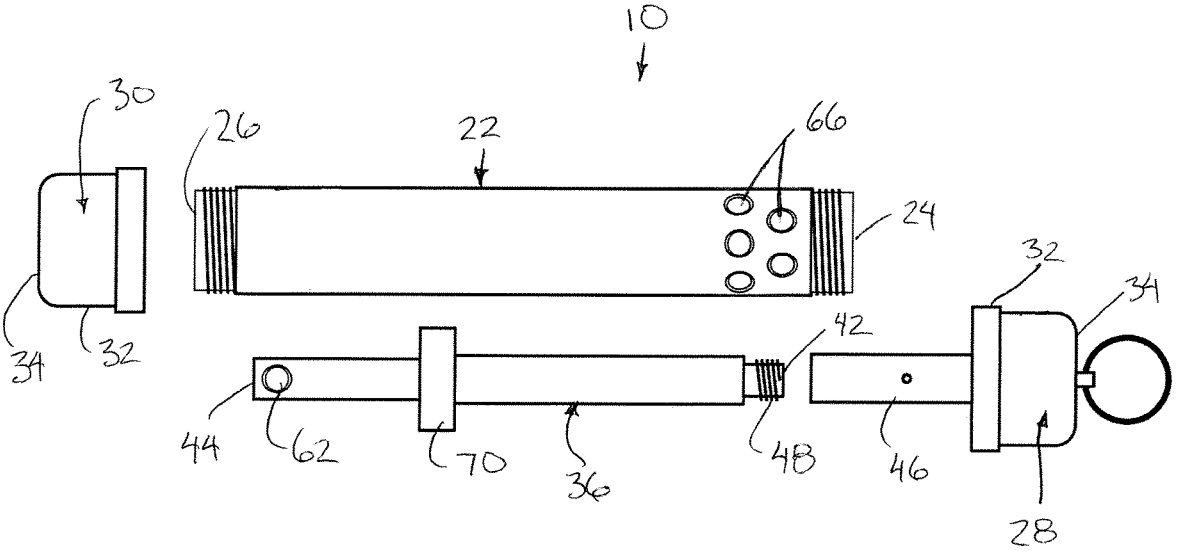
FIG. 6 is an exploded side elevational view of the simulated explosive device.
Figure 7:
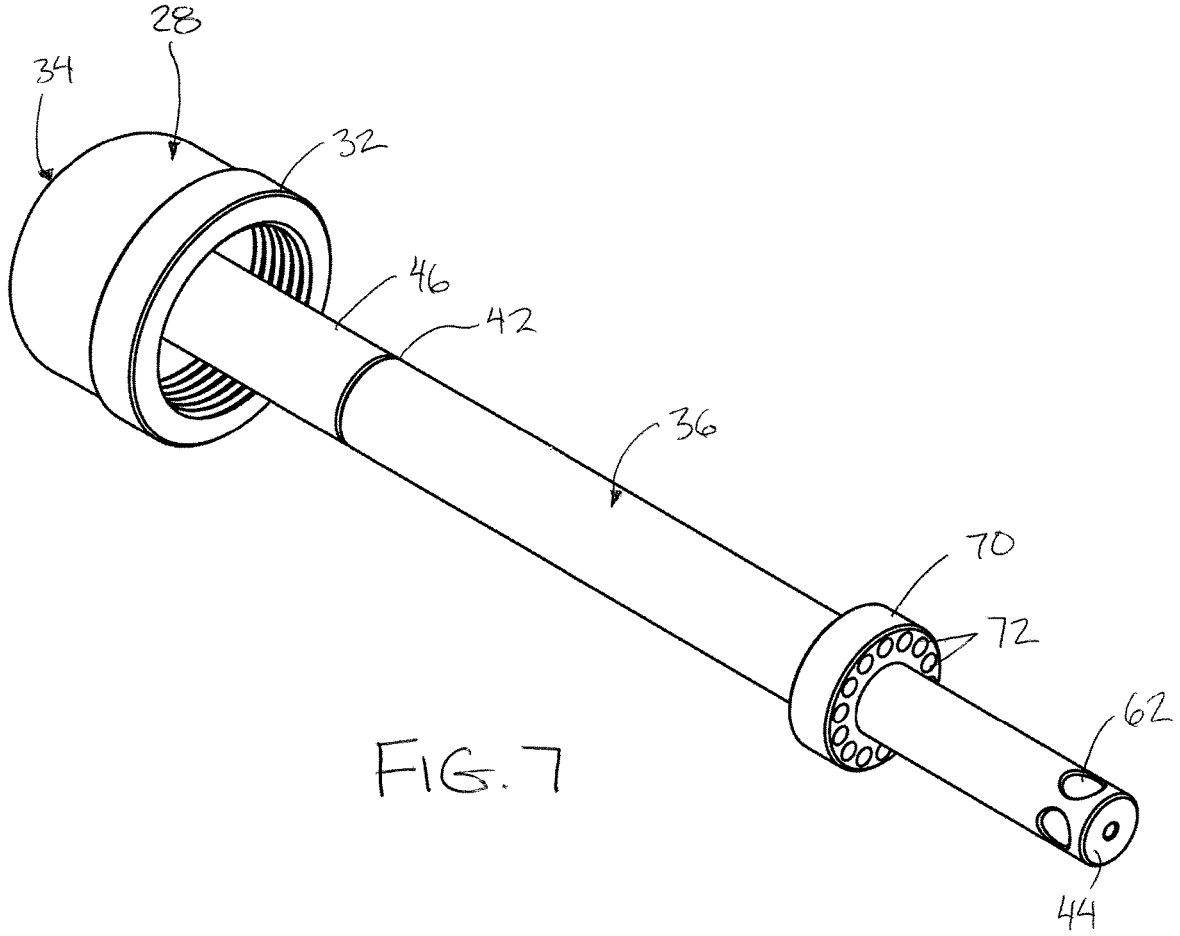
FIG. 7 is a perspective view of the inner casing shown removed from the outer casing of the simulated explosive device.
Figure 9:
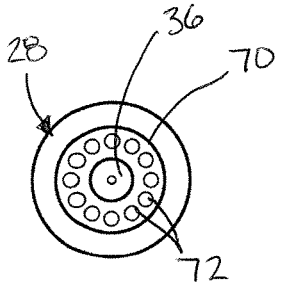
FIG. 9 is an end elevational view of the second end of the inner casing shown removed from the outer casing of the simulated explosive device.
Figure 8:
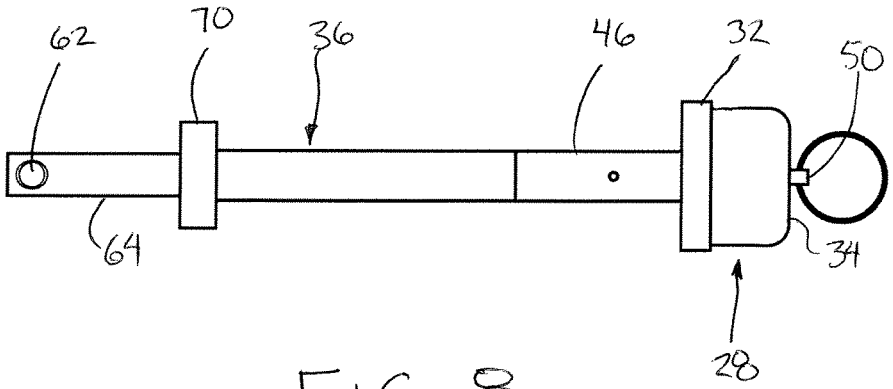
FIG. 8 is a side elevational view of the inner casing shown removed from the outer casing of the simulated explosive device.
Figure 10:
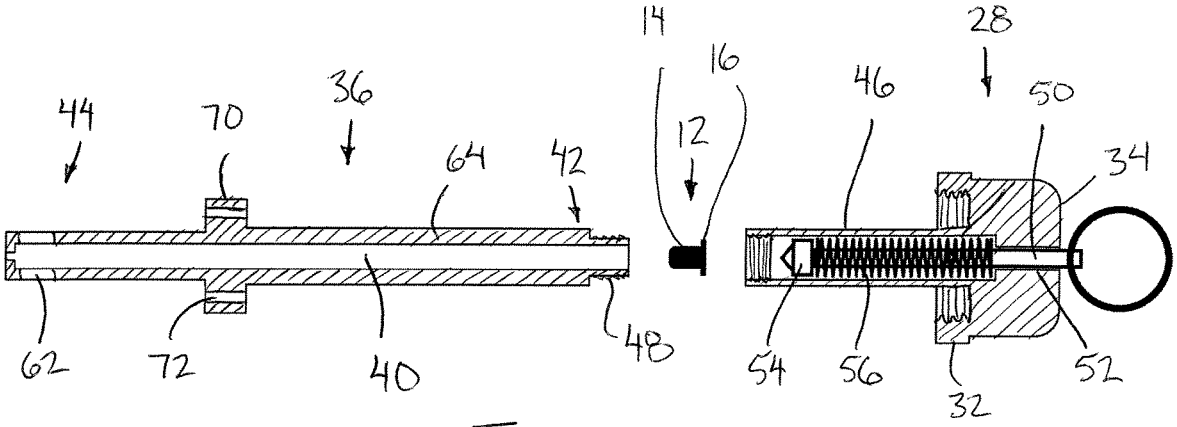
FIG. 10 is a partly sectional, exploded, elevational view of the inner casing shown removed from the outer casing of the simulated explosive device.

The striker assembly includes a shaft 50 which is coaxially aligned with the inner and outer casings and which is received through a respective axial bore 52 through the end wall 34 of the first end cap 28 such that the shaft 50 is slidable in the longitudinal direction of the device relative to the end cap. A striker head 54 is supported at an inner end of the shaft 50 which is enlarged in diameter relative to the axial bore 52 so as to remain contained within the interior of the device relative to the end cap, but which has an outer diameter which fits within the interior diameter of the sleeve portion 46 so that the striker head is longitudinally slidable within the sleeve portion 46. The striker head 54 is movable between a striking position as shown in FIG. 5 in which a pointed apex at the inner end of the striker head is located adjacent to the charge holder for engaging and striking a charge 12 supported therein, and an armed position in which the striker head 54 is spaced apart from the charge holder so as to be closer to the end wall of the end cap than in the striking position.

The striker assembly further includes a spring 56 supported about the shaft and within the sleeve portion 46 between the end wall 34 of the first end cap and the striker head 54. The spring is axially compressed to provide a biasing force to the striker head which urges the striker head from the armed position towards the striking position with sufficient force to strike the primer charge to cause ignition of the shock sensitive chemical therein. A transverse aperture 58 extends through the shaft 50 at a location which is directly adjacent the exterior side of the end wall 34 of the first end cap in the armed position of the striker head 54 such that an arming pin 60 can be inserted through the transverse aperture 58 at the exterior of the device to retain the striker head in the armed position against the biasing force of the spring 56.

In the assembled position of the inner casing relative to the outer casing, the second end 44 of the inner casing 36 is in close proximity to the second end 26 of the outer casing 22 while protruding slightly beyond the second end of the outer casing into the hollow interior of the second end cap. A plurality of intermediate ports 62 extend radially through the cylindrical wall 64 of the inner casing 36 adjacent to the second end of the inner casing for communication between the second end of the inner passage and the second end of the first passage. The intermediate ports 62 are provided at evenly spaced positions about the circumference of the inner casing. The inner casing is devoid of any openings between the charge holder at the first end 42 thereof and the intermediate ports 62 at the second end 44 thereof. An additional intermediate port 62 may also communicate axially through the end of the inner casing.

The outer casing includes a plurality of exhaust ports 66 extending radially through the cylindrical wall 68 of the outer casing in close proximity to the first end 24 of the outer casing. The outer casing is similarly devoid of any openings between the second end 26 thereof in communication with the intermediate ports 62 of the inner casing and the exhaust ports 66 at the first end 24.

In this manner, a flow path is defined from the charge 12 supported within the charge holder at the first end 42 of the inner casing to the exterior of the device. In this manner, the products of the exothermic reaction of the charge 12 are directed longitudinally along the length of the inner casing within the inner second passage 40, followed by communication through the intermediate ports 62 to be then directed longitudinally along the length of the outer casing within the annular first passage 38 up to the exhaust port 66 which allow the products to be exhausted from the device.

The device 10 also includes a flow restrictor comprising a restrictor body 70 supported to fully span across the annular first passage 38 at an intermediate location between the intermediate ports 62 and the exhaust ports 66 in the longitudinal direction. The restrictor body 70 is accordingly annular in shape to accommodate the shape of the first passage 38. In the illustrated embodiment, the restrictor body 70 is formed integrally as a unitary structure together with the inner casing 36 by forming the restrictor body to comprise a radially protruding flange or rib which protrudes from the outer surface of the inner casing about the full circumference thereof. The flow restrictor further comprises a plurality of axial ports 72 extending through the restrictor body 70 at evenly spaced positions about the circumference of the inner casing. The collective cross-sectional flow area through the axial ports 72 is reduced relative to the cross-sectional flow area of the remainder of the annular first passage 38 to provide some degree of restriction to the flow of products from the exothermic reaction of the charge therethrough.

The outer diameter of the restrictor body 70 is approximately equal to the inner diameter of the outer casing such that the restrictor body 70 also provides some radial support to maintain the inner casing concentrically aligned relative to the outer casing at a location which is longitudinally spaced from the connection of the first end 52 of the inner casing 36 to the first end cap 28.

In the illustrated embodiment, the axial ports 72 are located at an intermediate location in the radial direction of the restrictor body, however in further embodiments the axial ports may be located in close proximity to the outer circumference such that the axial ports are open to the cylindrical outer surface of the restrictor body 70. The axial ports 72 in this instance comprised longitudinally extending grooves formed in the cylindrical outer surface of the body so that the ports are bounded at the other side thereof by the inner surface of the outer casing in the mounted position of the flow restrictor body 70 within the outer casing.

The restrictor body 70 is located at an intermediate location so as to be spaced inwardly in the longitudinal direction from both ends of the inner and outer casings. In the illustrated embodiment, the restrictor body 70 is located closer to the second ends of the inner and outer casings than the first ends thereof. In addition, the restrictor body 70 is spaced longitudinally inwardly from the exhaust ports 66 so as to be nearer to the intermediate ports 62 at the second ends of the casings than the exhaust ports 66 which are in proximity to the first ends of the casings.

In use, an operator initially disassembles the device by separating the threaded connection between the first end cap 28 and the first end 24 of the outer casing 28 followed by separating the threaded connection between the first end 42 of the inner casing 36 and the sleeve portion 46 of the first end cap 28. A new pyrotechnic charge 12 may then be placed in the charge holder at the first end 42 of the inner casing 36 followed by re-attaching the inner casing 36 to the first end cap 28 and attachment of both end caps to the respective opposing ends of the outer casing 22. The striker assembly is then retained in the armed position by a suitable arming pin 60. A tripwire or other release mechanism can then be attached to the arming pin 60 for use within a simulated combat environment for training purposes.

When the release mechanism is activated to remove the arming pin 60, the biasing of the striker assembly causes the striker head to impact the charge 12 to cause ignition. The products of the resultant exothermic reaction of the pyrotechnic charge 12, including high-temperature sparks, are directed longitudinally along substantially the full length of both the inner and outer casings so that the sparks are substantially fully contained within the interior of the device 10. Meanwhile the noise produced by the charge 12 is freely emitted from the device 10 to provide a realistic noise representative of an actual improvised explosive device within a training environment while minimizing the potential for causing a fire or burn damage within the training environment.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A simulated explosive device for use with a pyrotechnic charge, the device comprising:

an outer casing extending in a longitudinal direction between a first end and a second end of the outer casing;

a first exhaust passage defined within the outer casing to extend in the longitudinal direction between a first end of the first exhaust passage in proximity to the first end of the outer casing and a second end of the first exhaust passage in proximity to the second end of the outer casing;

an inner casing supported within the outer casing to extend in the longitudinal direction between a first end and a second end of the inner casing;

a second exhaust passage defined within the inner casing to extend in the longitudinal direction between a first end of the second exhaust passage in proximity to the first end of the inner casing and a second end of the second exhaust passage in proximity to the second end of the inner casing;

a charge holder supported at the first end of the second exhaust passage so as to be arranged to support the pyrotechnic charge in communication with the first end of the second exhaust passage;

at least one intermediate port in communication between the second end of the second exhaust passage and the second end of the first exhaust passage;

at least one exhaust port in communication from the first exhaust passage to an exterior of the outer casing;

said at least one exhaust port being in proximity to the first end of the first exhaust passage.

2. The device according to claim 1 further comprising a flow restrictor supported in the first exhaust passage.

3. The device according to claim 2 wherein the flow restrictor is located at an intermediate location along the first exhaust passage, spaced inwardly from both the first end and the second end of the first exhaust passage.

4. The device according to claim 2 wherein the flow restrictor is located nearer to the second end of the first exhaust passage than the first end of the first exhaust passage.

5. The device according to claim 2 wherein the flow restrictor comprises a restrictor body spanning across the first exhaust passage and a plurality of restrictor ports communicating in the longitudinal direction through the restrictor body.

6. The device according to claim 1 wherein the outer casing is devoid of openings in communication with the first exhaust passage between the second end of the first exhaust passage and said at least one exhaust port that is in proximity to the first end of the first exhaust passage.

7. The device according to claim 6 wherein the outer casing is devoid of openings in communication with the first exhaust passage along a majority of a length of the first exhaust passage.

8. The device according to claim 6 further comprising a flow restrictor supported in the first exhaust passage between the first end of the first exhaust passage and said at least one exhaust port, wherein the outer casing is devoid of openings in communication with the first exhaust passage between the second end of the first exhaust passage and the flow restrictor.

9. The device according to claim 1 wherein said at least one exhaust port extends radially through a cylindrical wall of the outer casing.

10. The device according to claim 1 wherein said at least one intermediate port extends radially through a cylindrical wall of the inner casing between the second exhaust passage and the first exhaust passage.

11. The device according to claim 1 wherein the inner casing is received within the first exhaust passage of the outer casing such that the first exhaust passage is annular in shape between the inner casing and the outer casing.

12. The device according to claim 1 further comprising a striker supported on the second end of the outer casing so as to be slidable between a striking position in proximity to the charge holder and an armed position spaced from the charge holder, a biasing element coupled to the striker to bias the striker towards the striking position, and an arming pin releasable coupled to the striker to selective retain the striker in the armed position.

* * * * *